United States Patent [19]

Garner

[11] 4,014,348

[45] Mar. 29, 1977

[54] SMOKING MIXTURE

[75] Inventor: Edward Garner, Manchester, England

[73] Assignee: Imperial Chemical Industries Limited, London, England

[22] Filed: June 9, 1975

[21] Appl. No.: 584,955

[30] Foreign Application Priority Data

July 5, 1974 United Kingdom ..... 29898/74

[52] U.S. Cl. ..... 131/2

[51] Int. Cl.[2] ..... A24B 15/00

[58] Field of Search ..... 131/2, 17 R, 140, 266–269

[56] References Cited

UNITED STATES PATENTS

| | | | |
|---|---|---|---|
| 3,428,054 | 2/1969 | Scarabello et al. | 131/265 |
| 3,608,560 | 9/1971 | Briskin et al. | 131/2 |
| 3,885,574 | 5/1975 | Borthwick et al. | 131/2 |
| 3,885,575 | 5/1975 | Parker et al. | 131/2 |

FOREIGN PATENTS OR APPLICATIONS

| | | | |
|---|---|---|---|
| 1,362,398 | 5/1964 | France | 131/267 |

OTHER PUBLICATIONS

Def. Pub. T912,011, Published 7/24/73, Harpham et al.

*Primary Examiner*—Robert W. Michell
*Assistant Examiner*—Vincent A. Millin
*Attorney, Agent, or Firm*—Cushman, Darby & Cushman

[57] ABSTRACT

An improved smoking mixture comprising cellulose or a modified cellulose as smoke-producing fuel and up to 5% by weight of melamine.

9 Claims, No Drawings

SMOKING MIXTURE

This invention relates to smoking mixtures.

In view of the widely held opinion that the smoking of tobacco, especially in cigarette form, can cause lung cancer and bronchitic ailments attention is turning to the provision of smoke-producing substrates which produce less tar and other harmful substances than tobacco, for example to cellulose, cellulose ethers, particularly carboxymethylcellulose and its salts, oxidised cellulose and particularly to heat treated cellulose prepared for example by the process described and claimed in our United Kingdom Patent No. 1,113,979.

Such smoke-producing substrates give rise to formaldehyde and the smoke from them may contain amounts of formaldehyde comparable with or even higher than the amount in tobacco smoke. Formaldehyde is a known irritant and it is therefore desirable to improve substrates such as the aforesaid in a way which reduces the formaldehyde content of the smoke therefrom.

According to the invention an improved smoking mixture comprises cellulose or a modified cellulose as smoke-producing fuel and up to 5% by weight of melamine (2,4,6-triamino-s-triazine).

Cellulose used as smoke producing fuel may be in a purified form, particularly $\alpha$-cellulose, or as vegetable matter for example as dried lettuce leaves, or preferably as tobacco.

The term "modified" means chemically modified and implies that the original carbohydrate has undergone a change of a chemical nature.

Modified carbohydrate used as smoke-producing fuel may desirably comprise a thermally degraded carbohydrate, especially thermally degraded cellulose, prepared by subjecting carbohydrate to a catalysed degradation process at a temperature of above 100° C e.g. at 100–250° C as described and claimed in our UK Patent No. 1,113,979 until the weight of degraded material is less than 90% of the dry weight of the original carbohydrate.

The modified carbohydrate used as smoke-producing fuel may also comprise a solid condensate prepared by acid or base catalysed condensation of a compound of the formula $$R^1CO\ CH_2.CH_2\ COR^2$$

(or a precursor thereof) wherein $R^1$ and $R^2$, which may be the same or different, each represents a hydrogen atom, or an alkyl, hydroxyalkyl or formyl group. Such condensates in fabricated form are described and claimed in our United Kingdom Patent No. 1,298,354.

Further examples of modified carbohydrates which may be used as smoke-producing fuel are oxidised cellulose (see for example Kenyon et al. "Industrial and Engineering Chemistry", Volume 41, page 2 et seq) and cellulose ethers, particularly carboxymethyl cellulose and its salts.

Preferred proportions of melamine in the smoking mixtures of the invention, giving the best results, are from 1 to 3% by weight.

The smoking mixtures of the invention may contain other ingredients to impart desired physical properties and burning characteristics. Such ingredients may for example, comprise:

Inorganic fillers. By suitable choice of inorganic compounds high proportions (e.g. 40 to 65% by weight) of filler may be incorporated while maintaining an acceptable burning rate.

Binders, particularly film forming agents, e.g. methyl cellulose, sodium carboxymethylcellulose, pectins, gums.

Modified carbohydrates which are binders may constitute the whole of the smoke-producing fuel if desired.

Humectants, e.g. glycerol, glycols.

Glow-controlling catalysts e.g. potassium citrate.

Colouring matters.

Ash cohesion agents, e.g. citric acid, bentonite.

Nicotine or a nicotine salt.

Substances producing acidic matter in the smoke in order to counteract the "chokiness" of the nicotine, e.g. volatile acids, neutral substances pyrolysing to volatile acids, or weak base salts.

The smoking mixture of the invention may, if desired, be in a fabricated form simulating tobacco or in a form from which tobacco-simulating material can be produced, for example, in sheet form. When the smoke-producing fuel is not tobacco, fabricated forms of the smoking mixtures are preferred. Known techniques of fabrication may be used to prepare the smoking mixtures. Thus the ingredients, including a binder when the modified carbohydrate constituting the main smoke-producing fuel is not itself a binder, may be slurried with water and cast, rolled or extruded on to a drying surface.

Smoking mixtures of the invention have a smaller formaldehyde smoke delivery than comparable mixtures not containing melamine.

Additionally those smoking mixtures which contain nicotine or nicotine salts as well as melamine may produce greater "satisfaction" to the smoker than comparable mixtures containing no melamine. Consequently the amount of nicotine required to produce a satisfying smoking mixture may be decreased by the presence of the melamine If desired the smoking mixture of the invention may be blended with tobacco.

The invention is illustrated but not limited by the following Examples in which all parts and percentages are by weight.

Thermally degraded cellulose used in the Examples was obtained by impregnating cellulose with 7% ammonium sulphamate solution, compressing so that the cellulose retained its own weight of solution, drying at 165° C and then heating at 265° C until a loss in weight of 25–30% occurred.

EXAMPLE 1

A smoking mixture of the following composition was made by slurrying the ingredients with water, casting into a film and drying.

| | % |
|---|---|
| Thermally degraded cellulose | 26.9 |
| Sodium carboxymethyl cellulose (SCMC) | 15.0 |
| Glycerol | 6.0 |
| Magnesium carbonate | 28.6 |
| Calcium carbonate | 16.5 |
| Bentonite | 5.0 |
| Melamine | 2.0 |

The film was shredded and made up into standard cigarettes weighing 1.1 g, 70 mm long and 25 mm in circumference. These were smoked on a standard machine taking 35 mm puffs of 2 seconds duration once every minute, and the smoke was analysed for formaldehyde by the method of Spincer and Chard — Beitrage zur Tabakforschung Band 6, Heft 2, pages 74–78 (September 1971).

Average formaldehyde delivery was 34 μg per cigarette.

Otherwise indentical cigarettes from which the melamine was omitted had an average formaldehyde delivery of more than 200 μg per cigarette.

Inclusion of melamine at 1% level gave cigarettes with an average formaldehye delivery considerably less than this.

EXAMPLE 2

A smoking mixture of the following composition was made by slurrying the ingredients with water, casting into a film and drying.

| | % |
|---|---|
| Thermally degraded cellulose | 26.0 |
| SCMC | 14.5 |
| Glycerol | 5.8 |
| Bentonite | 4.8 |
| Nicotine | 3.5 |
| Chalk | 15.4 |
| Magnesium carbonate | 28.0 |
| Melamine | 2.0 |

The film was shredded and made up into the standard cigarettes described in Example 1 which were smoked on the standard smoking machine as described and the smoke analysed for formaldehyde.

Average formaldehyde delivery was 18 μg per cigarette.

Otherwise identical cigarettes from which the melamine was omitted had an average formaldehyde delivery of 68 μg per cigarette.

EXAMPLE 3

A smoking mixture of the following composition was made by slurrying the ingredients with water, casting into a film and drying.

| | % |
|---|---|
| SCMC | 30.0 |
| Glycerol | 7.7 |
| Perlite | 30.0 |
| Charcoal | 0.3 |
| Calcium carbonate | 30.0 |
| Melamine | 2.0 |

The film was shredded and made up into the standard cigarettes described in Example 1 which were smoked on the standard smoking machine as described and the smoke analysed for formaldehyde.

Average formaldehyde delivery was 29 μg per cigarette.

Otherwise identical cigarettes from which the melamine was omitted had an average formaldehyde delivery of 52 μg per cigarette.

EXAMPLE 4

A hot aqueous solution of melamine was sprayed on to tobacco rag and dried to give a tobacco impregnated with 2% weight of melamine. A further sample of the same tobacco was sprayed with hot water and dried in the same way. Each tobacco sample was made up into the standard cigarettes described in Example 1, which were smoked on the standard smoking machine as described and the smoke analysed for formaldehyde.

Average formaldehyde delivery from the cigarettes which contained melamine was 21 μg per cigarette.

The cigarettes which did not contain melamine had an average formaldehyde delivery of 80 μg per cigarette.

EXAMPLE 5

A smoking mixture of the following composition was made by slurrying the ingredients with water, casting it into a film and drying.

| | % |
|---|---|
| Magnesium carbonate | 32 |
| Calcium carbonate | 18 |
| Cellulose powder | 27 |
| SCMC | 9 |
| Potassium citrate | 4 |
| Glycerol | 7 |
| Melamine | 3 |

The film was shredded and made up into the standard cigarettes described in Example 1, which were smoked on the standard smoking machine as described and the smoke analysed for formaldehyde.

Average formaldehyde delivery was 26 μg per cigarette.

Otherwise identical cigarettes from which the melamine was omitted had an average formaldehyde delivery of 106 μg per cigarette.

EXAMPLE 6

A smoking mixture of the following composition was made by slurrying the ingredients with water, casting it into a film and drying.

| | % |
|---|---|
| Magnesium carbonate | 31 |
| Calcium carbonate | 17 |
| Cellulose powder | 27 |
| SCMC | 9 |
| Potassium citrate | 4 |
| Glycerol | 7 |
| Melamine | 5 |

The film was shredded and made up into the standard cigarettes described in Example 1, which were smoked on the standard smoking machine as described and the smoke analysed for formaldehyde.

Average formaldehyde delivery was 19 μg per cigarette.

Otherwise identical cigarettes from which the melamine was omitted had an average formaldehyde delivery of 106 μg per cigarette.

We claim:

1. An improved smoking mixture comprising cellulose or a modified cellulose as smoke-producing fuel and up to 5% by weight of melamine.

2. An improved smoking mixture according to claim 1 comprising a thermally degraded carbohydrate as smoke-producing fuel.

3. An improved smoking mixture according to claim 2 comprising as smoke-producing fuel a thermally degraded carbohydrate prepared by subjecting carbohydrate to a catalysed degradation at above 100° C until the weight of the degraded material is less than 90% of the dry weight of the original carbohydrate.

4. An improved smoking mixture according to claim 3 wherein the thermally degraded carbohydrate is thermally degraded cellulose.

5. An improved smoking mixture according to claim 1 comprising carboxymethylcellulose or a salt thereof as smoke-producing fuel.

6. An improved smoking mixture according to claim 1 comprising tobacco as smoke-producing fuel.

7. An improved smoking mixture according to claim 1 wherein the proportion of melamine is from 1 to 3% by weight.

8. An improved smoking mixture according to claim 1 containing 40 to 65% by weight of inorganic filler.

9. An improved smoking mixture according to claim 1 in a fabricated form simulating tobacco, or in a form from which tobacco-simulating material can be produced.

* * * * *